US005712770A

United States Patent [19]

Huang

[11] Patent Number: 5,712,770

[45] Date of Patent: Jan. 27, 1998

[54] FIGURE LIGHT ASSEMBLY

[75] Inventor: Peter K. H. Huang, Taipei, Taiwan

[73] Assignee: Shining Blick Enterprises Co., Ltd., Taipei, Taiwan

[21] Appl. No.: 727,009

[22] Filed: Oct. 8, 1996

[51] Int. Cl.[6] ..... F21P 1/02

[52] U.S. Cl. ..... 362/252; 362/249; 362/806

[58] Field of Search ..... 362/249, 252, 362/806, 807, 808, 382; 211/26, 89; 248/316.1, 316.7

[56] References Cited

U.S. PATENT DOCUMENTS 2,722,317 11/1955 Goodwin ..... 362/807

4,769,749 9/1988 Falski ..... 362/252

4,795,121 1/1989 Comito ..... 362/806

*Primary Examiner*—Y. My Quach

*Attorney, Agent, or Firm*—Bacon & Thomas

[57] ABSTRACT

A figure light including a figured light mount molded from plastic, and a decorative string of lights mounted in the figured light mount, the figured light mount having a plurality of flat narrow strips integrally connected with one another, and a plurality of light mounting holes longitudinally spaced along the flat narrow strips and into which the lights of the decorative string of lights are press fitted.

4 Claims, 7 Drawing Sheets

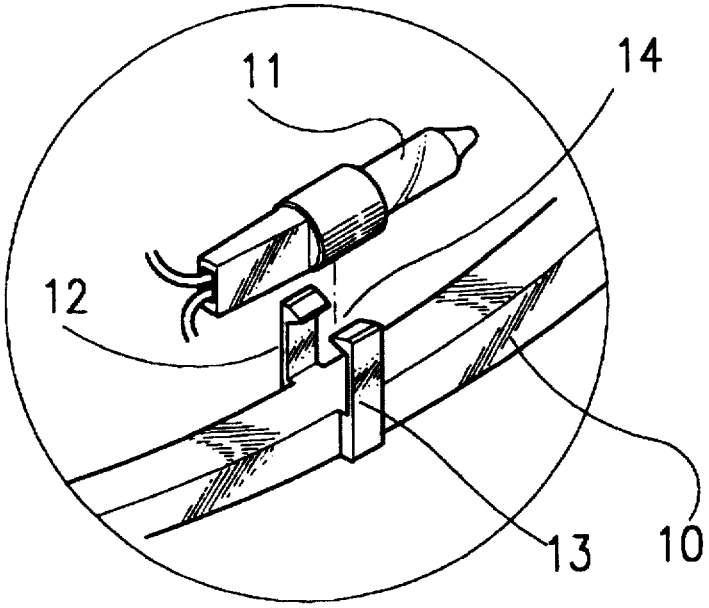
FIG.2 *PRIOR ART*
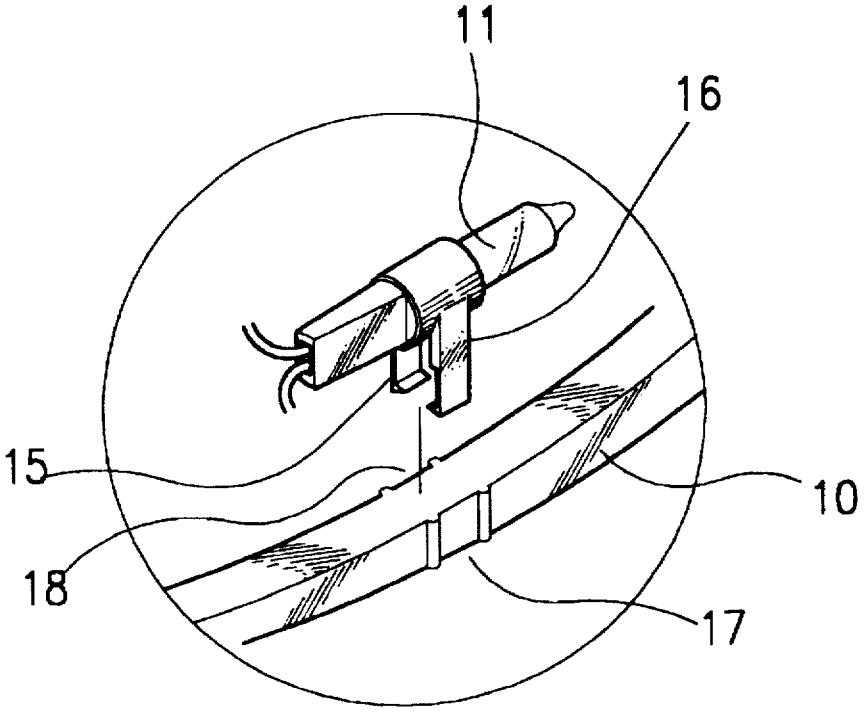
FIG.3 *PRIOR ART*

FIGURE LIGHT ASSEMBLY

BACKGROUND OF THE INVENTION

The present invention relates to a figure light assembly which is directly molded from plastic and having light mounting holes into which lights are press-fit.

Various figured lights have been disclosed for decoration. FIG. 1 shows a figured light according to the prior art. This figured light is comprised of a figured light mount 10, and a decorative string of lights 11 installed in the figured light mount 10. The figured light mount 10 is comprised of a plurality of narrow strips connected with one another to show a particular pattern for example, a Christmas tree. When fastening the lights 11 to the figured light mount 10, fastening means shall be provided. The fastening means may be variously embodied. In FIG. 2, the fastening means comprises pairs of upright hooks 12, 13 bilaterally raised from the narrow strips of the figured light mount 10, and adapted for holding the lights 11. A mouth 14 is defined between each pair of upright hooks 12, 13 for the installation of a light 11. In FIG. 3, the fastening means comprises pairs of mounting grooves 17, 18 disposed at two opposite sides of each narrow strip of the figured light mount 10, and pairs of downward hooks 15, 16 respectively and bilaterally raised from the lamp holder of each light 11 and adapted for hooking on the pairs of mounting grooves 17, 18 respectively. These two structures of fastening means complicate the molding procedure of the figured light mount 10 or the lamp holders of the lights 11, thereby causing the manufacturing cost of the figure light to be relatively increased. Furthermore, because the lights 11 are respectively mounted on the narrow strips of the figured light mount 10, the lighting effect of the lights 11 can be seen clearly only from one side (namely, the front side). When viewing from the other side (namely, the back side), the lighting effect of the lights 11 is partially blocked by the narrow strips of the figured light mount 10.

SUMMARY OF THE INVENTION

The present invention has been accomplished to provide a figure light assembly which eliminates the aforesaid drawbacks. It is one object of the present invention to provide a figure light which is inexpensive to manufacture. It is another object of the present invention to provide a figure light which produces a lighting effect in all directions. According to the present invention, the figure light comprises a figured light mount molded from plastic, and a decorative string of lights mounted in the figured light mount, wherein the figured light mount comprises a plurality of flat narrow strips integrally connected with one another, and a plurality of light mounting holes longitudinally spaced along the flat narrow strips and within which the lights of the decorative string of lights are press fitted.

BRIEF DESCRIPTION OF THE DRAWINGS

FIG. 2 is an enlarged view of a part of FIG. 1 showing one light mounting structure;

FIG. 3 is an enlarged view of another part of FIG. 1, showing another light mounting structure;

DETAILED DESCRIPTION OF THE PREFERRED EMBODIMENT

Figure 1:
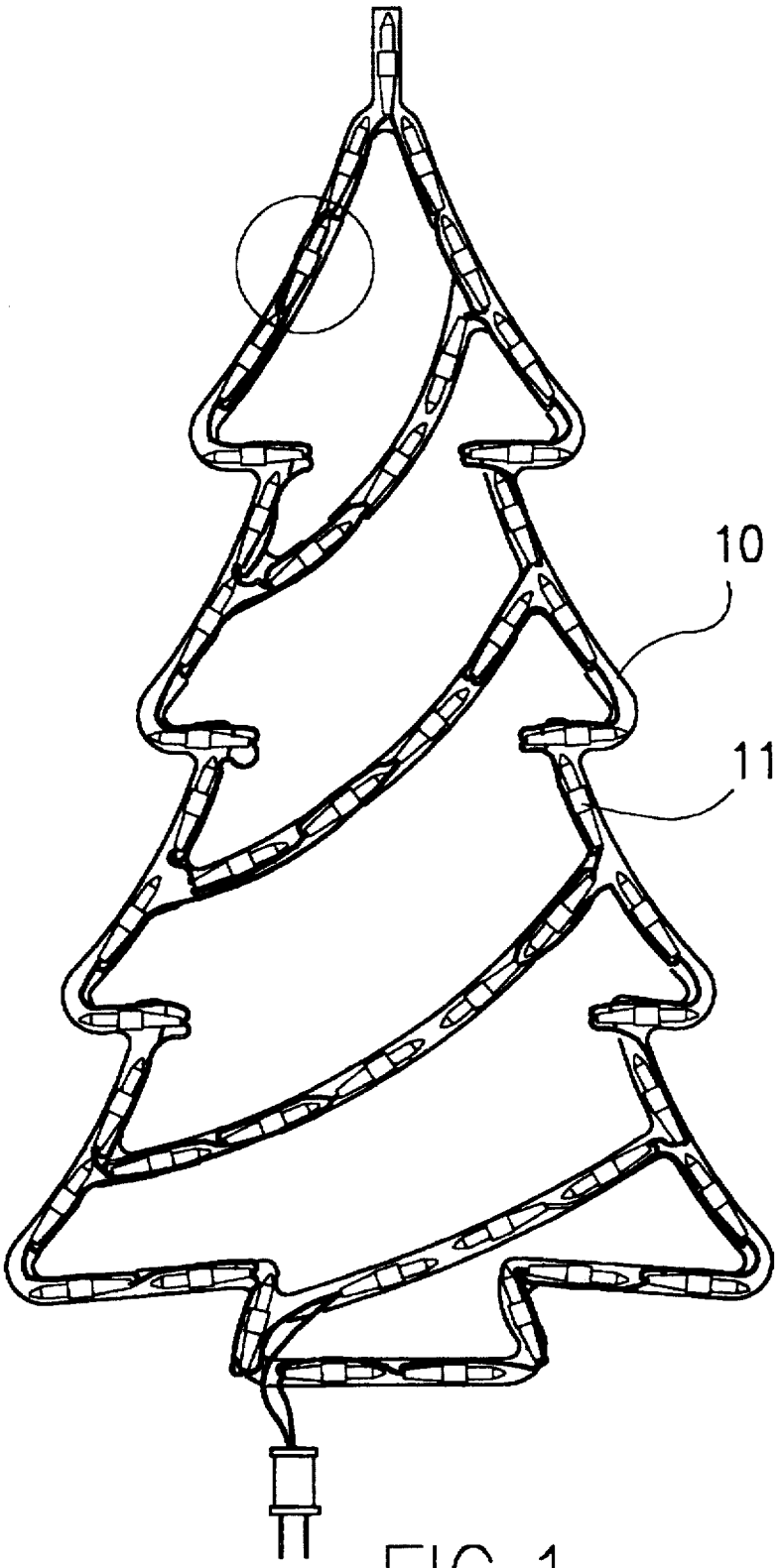
FIG. 1 PRIOR ART
FIG. 1 shows the structure of a figure light according to the prior art.
Figure 4:
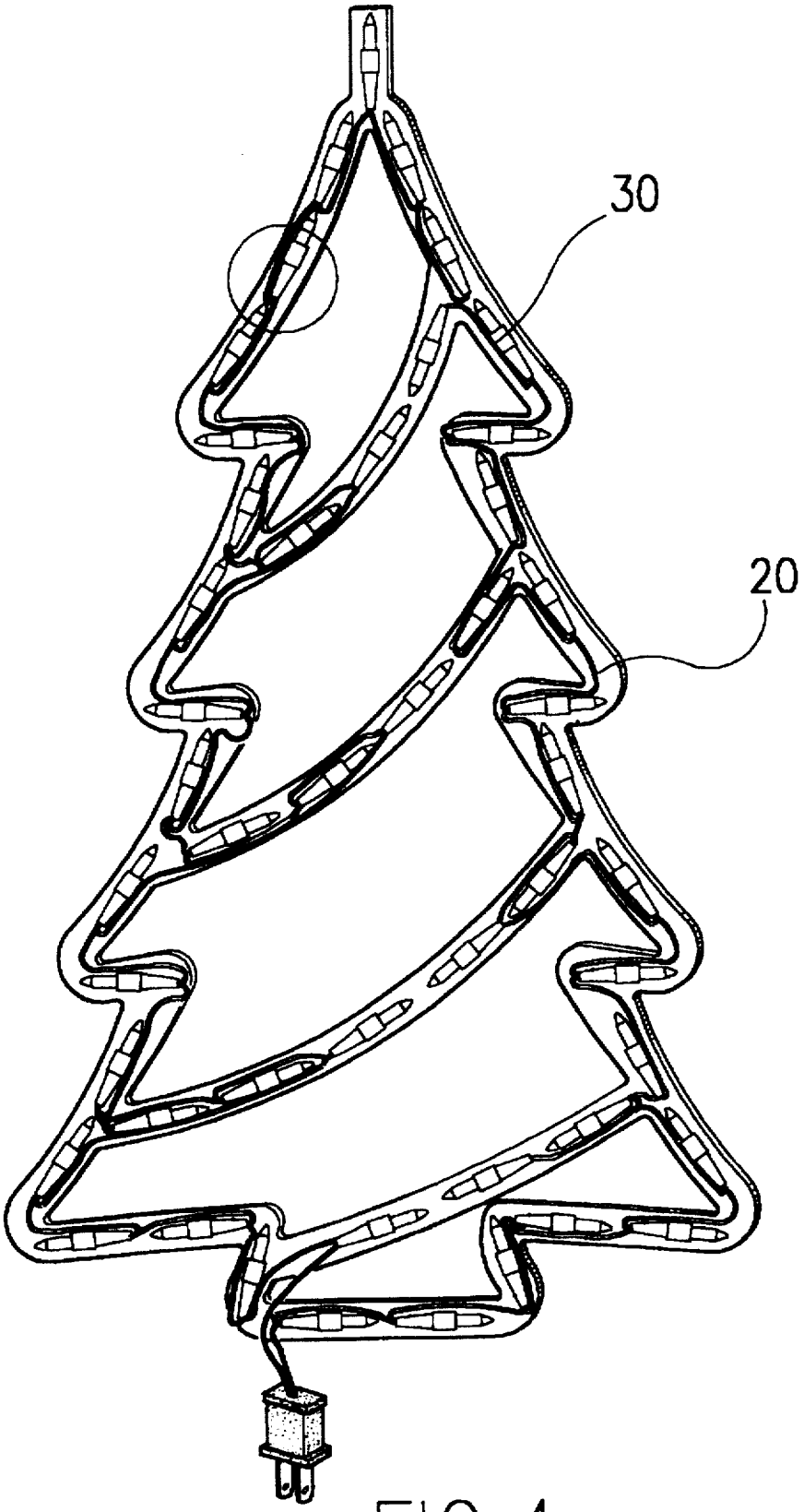
FIG. 4 shows the structure of a figure light assembly according to the present invention in a first configuration.

Referring to FIG. 4, a figure light assembly in accordance with the present invention comprises a figured light mount 20 adapted for holding a plurality of light assemblies 30. The figured light mount 20 is comprised of a plurality of flat elongate narrow strips, which are integrally molded from plastic and connected with one another to form a predetermined figure, and have a certain thickness.

Figure 5:
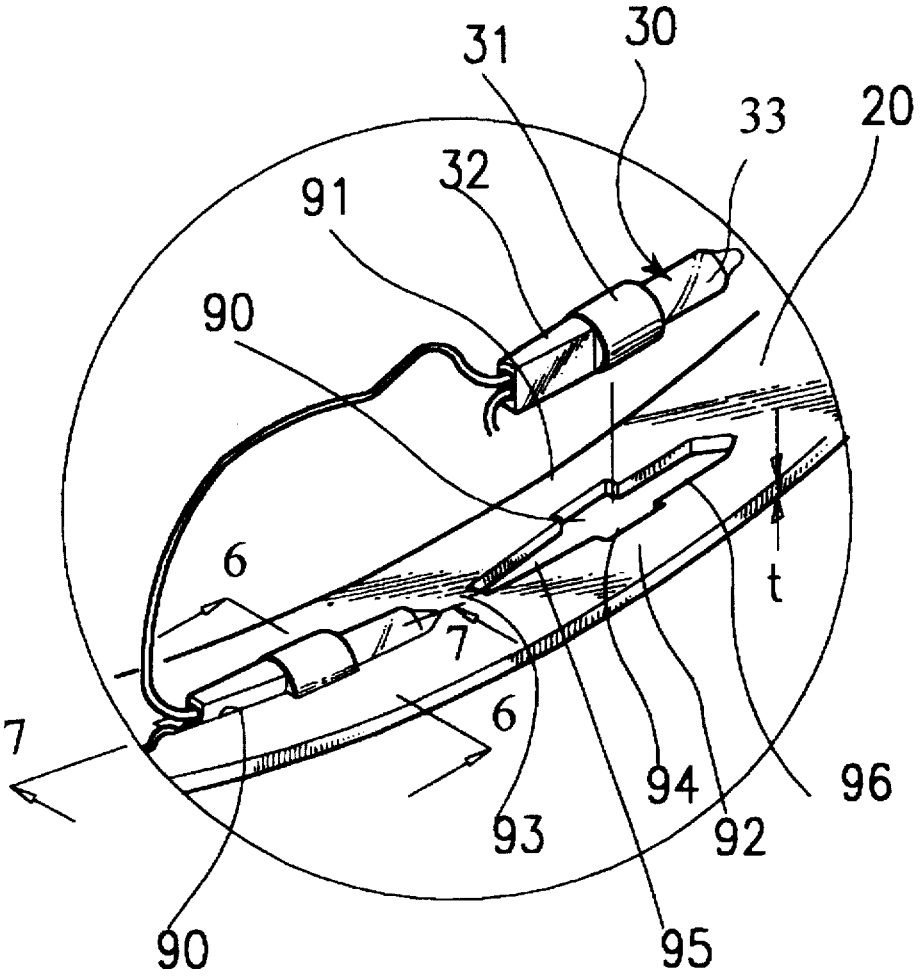
FIG. 5 is an enlarged view of a part of one flat narrow strip of the figured light mount of the figure light shown in FIG. 4.

Referring to FIG. 5, the figured light mount 20 has a plurality of light mounting holes 90 longitudinally spaced in the flat narrow strips thereof. The light mounting holes 90 are preferably disposed in the middle of the transverse width of the flat narrow strips of the figured light mount 20 so that the two solid portions 91, 92 at two opposite sides of the light mounting holes 90 can have a certain width respectively. Further, a solid partition portion 93 is connected between each two adjacent light mounting holes 90.

Figure 6:
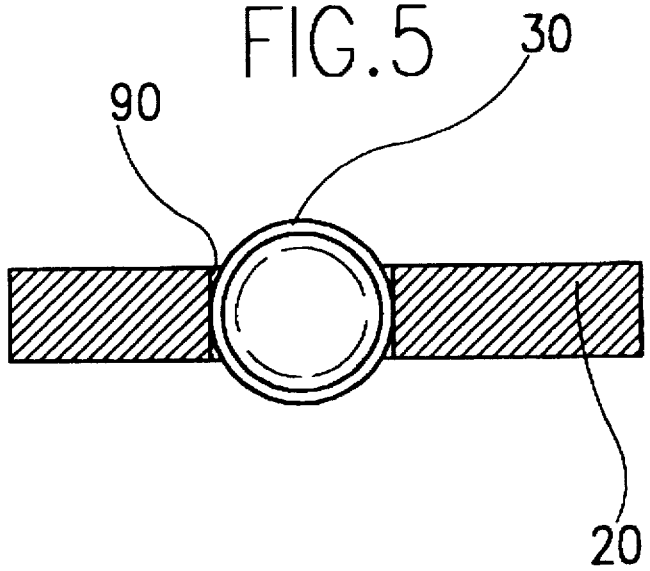
FIG. 6 is a sectional view on an enlarged scale taken along line 6—6 of FIG. 5.
Figure 7:
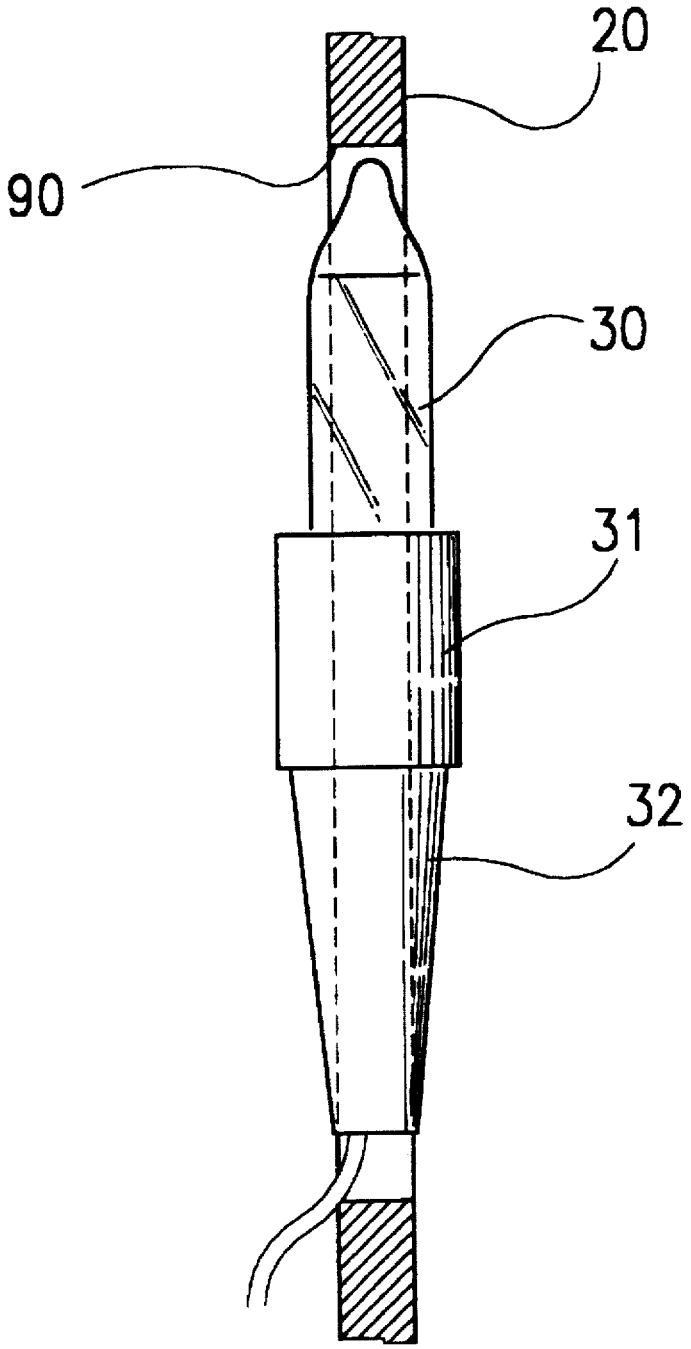
FIG. 7 is a sectional view on an enlarged scale taken along line 7—7 of FIG. 5.

Referring to FIGS. 6 and 7, and FIG. 5 again, each light mounting hole 90 is of a substantially elongate configuration and comprises a front section 96, a rear section 95 of which the width gradually reduces toward the end, and a middle section 94. Each light assembly 30 comprises a lamp holder 31 that is press fitted in the middle section 94 of the corresponding light mounting hole 90. The lamp holder 31 has a tapered rear end 32 that is press fitted into the rear section 95 of the corresponding light mounting hole 90. When installed, a bulb 33 of each light assembly 30 is press fitted into the front section 96 of the corresponding light mounting hole 90. If desired, the lamp holder 31 of each light 30 can be sealed to the figures light mount 20 by a heat sealing apparatus.

As apparent, the mounting hole 90 is of substantially the same configuration as light 30 in order to permit the press fitting of light 30 onto light mount 20. Due to the longitudinal alignment of each light 30 with its corresponding mounting hole 90 and the flat configuration of light mount 20, a minimum profile is realized from the assembly, as shown in FIG. 6. This permits the illumination given off by light 30 to be visible from virtually all directions and facilitates the packing, storing and transporting of the figure light assembly.

Figure 8:
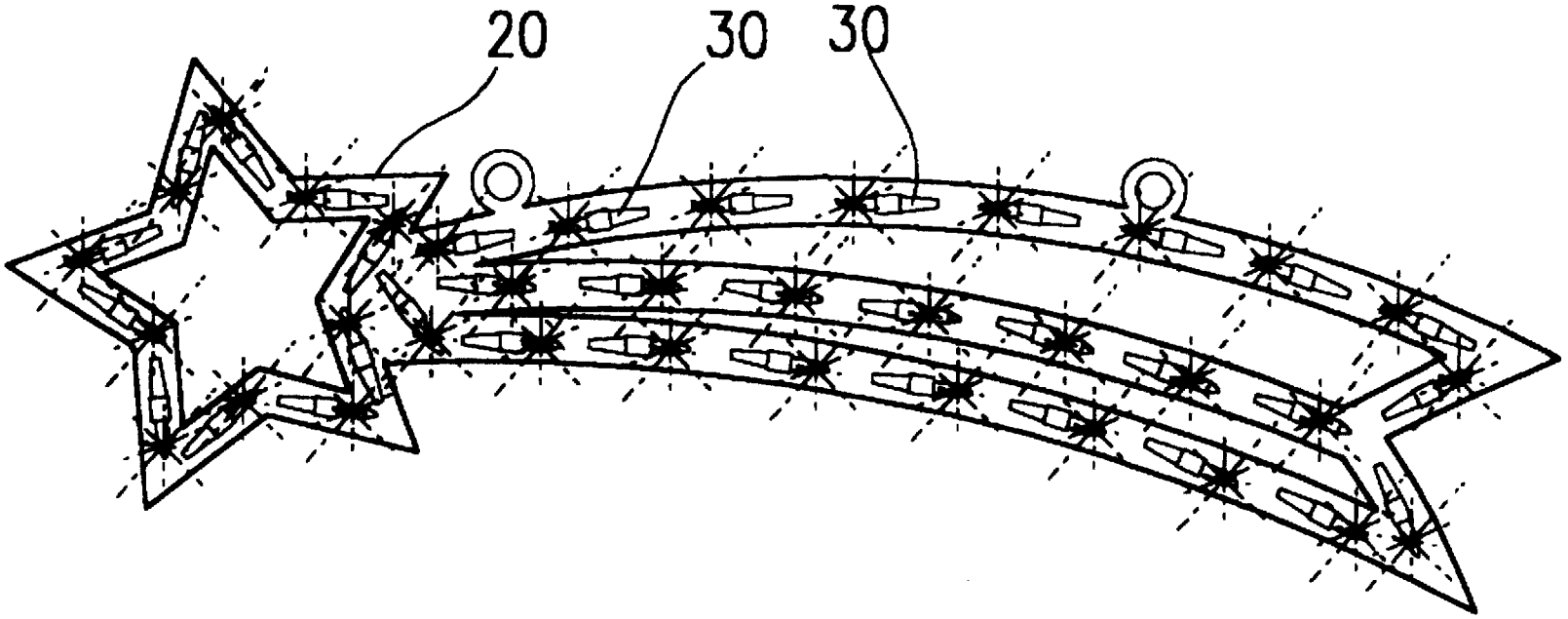
FIG. 8 shows a second configuration of the figure light assembly according to the present invention.
Figure 9:
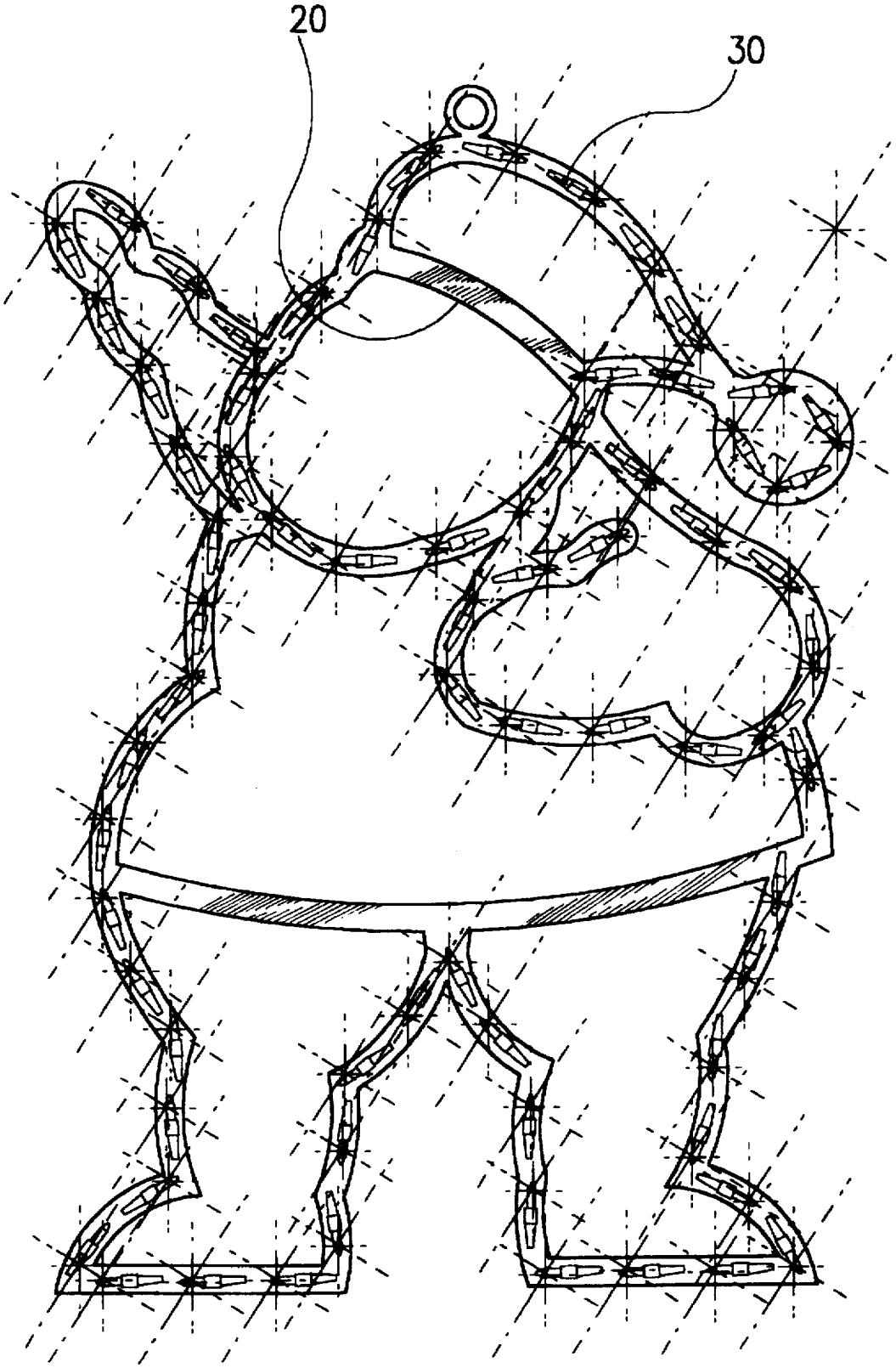
FIG. 9 shows a third configuration of the figure light assembly according to the present invention.

The light mount 20 can be arranged in any of a variety of shapes, for example a meteor as shown in FIG. 8, or a Santa Claus as shown in FIG. 9.

It is to be understood that the drawings are designed for purposes of illustration only, and are not intended as a definition of the limits and scope of the disclosed invention.

What the invention claimed is:

1. A figure light assembly comprising:

a) a plurality of elongate light mounts longitudinally connected together and defining a figure;

b) a plurality of light assemblies, each light assembly being of a substantially elongate configuration;

c) each light mount being of a flat strip configuration and having a plurality of substantially elongate mounting holes formed therein and longitudinally spaced therealong, a longitudinal axis of each mounting hole extending longitudinally of the light mount, and each mounting hole having a configuration corresponding to the configuration of the light assembly; and d) each light assembly being press fitted into each elongate mounting hole and extending outwardly from both sides of the light mount and providing illumination in substantially all directions from the light mount.

2. The figure light assembly of claim 1 wherein each mounting hole is formed in a middle of a transverse width of the light mount and two solid portions of the light mount positioned at opposite ends of the mounting hole.

3. The figure light assembly of claim 1 wherein the light mount includes a solid partition portion positioned between each two adjacent mounting holes.

4. The figure light assembly of claim 1 wherein:

a) each light assembly includes a lamp holder having a tapered rear end and a bulb installed within the lamp holder; and b) each mounting hole includes a middle section receiving the lamp holder, a rear section receiving the tapered rear end of the lamp holder and a front section receiving the bulb when the lamp assembly is press fitted into the mounting hole.

* * * * *